US008186451B2

(12) United States Patent
Ditzler

(10) Patent No.: US 8,186,451 B2
(45) Date of Patent: May 29, 2012

(54) INBOARD BLADE LIFT EYE

(75) Inventor: Steven Jay Ditzler, Bellevue, IA (US)

(73) Assignee: Deere & Company, Moline, IL (US)

( * ) Notice: Subject to any disclaimer, the term of this patent is extended or adjusted under 35 U.S.C. 154(b) by 38 days.

(21) Appl. No.: 12/511,300

(22) Filed: Jul. 29, 2009

(65) Prior Publication Data

US 2011/0024142 A1 Feb. 3, 2011

(51) Int. Cl.
*E02F 3/80* (2006.01)

(52) U.S. Cl. ..... 172/701.1

(58) Field of Classification Search ..... 37/231–236, 37/264, 266, 270, 271, 206, 214; 172/701.1, 172/810–834, 799.5
See application file for complete search history.

(56) References Cited

U.S. PATENT DOCUMENTS

| | | | | |
|---|---|---|---|---|
| 3,128,110 | A | 4/1964 | Herbenar | |
| 3,849,010 | A | 11/1974 | Herbenar | |
| 3,951,557 | A | 4/1976 | Herbenar | |
| 6,273,198 | B1 * | 8/2001 | Bauer et al. | 172/825 |
| 6,941,685 | B2 * | 9/2005 | Goy et al. | 37/232 |
| 7,690,441 | B2 * | 4/2010 | Matsumoto et al. | 172/811 |
| 2002/0127048 | A1 | 9/2002 | Schmidt et al. | |
| 2007/0003360 | A1 | 1/2007 | Ditzler | |

FOREIGN PATENT DOCUMENTS

WO 2007/032230 A1 3/2007

OTHER PUBLICATIONS

Pictures of dozer blade (Admited Prior Art, at least as of Jul. 29, 2009) (4 pages).
Pictures of loader bucket (Admited Prior Art, at least as of Jul. 29, 2009) (5 pages).
Pictures of 744K loader bucket (Admitted Prior Art, at least as of Jul. 29, 2009)(6 pages).
Pictures of dozer blade-2 (Admitted Prior Art, at least as of Jul. 29, 2009)(4 pages).
Image of loader bucket (Admitted Prior Art, at least as of Jul. 29, 2009)(1 page).

* cited by examiner

*Primary Examiner* — Robert Pezzuto

(57) ABSTRACT

A blade for a work vehicle comprises longitudinally opposite first and second ends and a blade lift eye positioned closer to the first end than the second end atop the blade. The blade lift eye is inboard of the first end.

21 Claims, 11 Drawing Sheets

18
158
160
118
110
12
66
66b
66a
48b
48a
42
41
54
60
44-1
58
62
64b
64
54
64a
65
56
54
44-2
48
44-3
38
48b
48a
47
48

INBOARD BLADE LIFT EYE

FIELD OF THE DISCLOSURE

The present disclosure relates to a blade for a work vehicle, and, more particularly, to positioning of a blade lift eye on the blade.

BACKGROUND OF THE DISCLOSURE

There are blades for work vehicles, such as dozer blades, which are heavy and have blade lift eyes traditionally positioned atop the blade at the longitudinally opposite ends of the blade. As is well known, a hoist (e.g., an inverted Y-shaped hoist) may be coupled to the lift eyes to lift and move the blade in order, for example, to aid in installation, maintenance (e.g., the blade pivot points), and replacement of the blade.

The ends of dozer blades, and the lift eyes thereof, frequently become damaged during dozing operations, and the damaged lift-eye area needs to be repaired before a blade can be removed or before further maintenance can be performed. There have been complaints from the field about such lift-eye damage. Further, visibility around the ends of the blade is important to human operators, and placement of the lift eyes on the ends can affect that visibility. In addition, to avoid interference with an inverted Y-shaped hoist, blade control towers mounted near the ends of the blade typically need to be removed before the hoist can be coupled to the lift eyes.

SUMMARY OF THE DISCLOSURE

According to an aspect of the present disclosure, there is provided a blade for a work vehicle comprising longitudinally opposite first and second ends and a blade lift eye positioned atop the blade closer to the first end than the second end. The blade lift eye is inboard of the first end. The blade may have a second blade lift eye positioned atop the blade closer to the second end than the first end and inboard of the second end.

Inboard positioning of the one or more blade lift eyes may offer a number of benefits. For example, each blade lift eye may thus be positioned in a relatively damage-free area such that the blade lift eye is less susceptible to damage than if it were at the respective end of the blade. Further, the first and second ends of the blade may be lower than the first and second blade lift eyes, respectively, enhancing operator visibility over the blade ends from the operator's station. Also, if the blade is fitted with a blade control tower at either end, an inverted Y-shaped hoist may be coupled to the lift eyes without requiring prior removal of the towers from the blade.

The above and other features will become apparent from the following description and the attached drawings.

BRIEF DESCRIPTION OF THE DRAWINGS

The detailed description of the drawing refers to the accompanying figures in which.

DETAILED DESCRIPTION OF THE DRAWINGS

Figure 1:
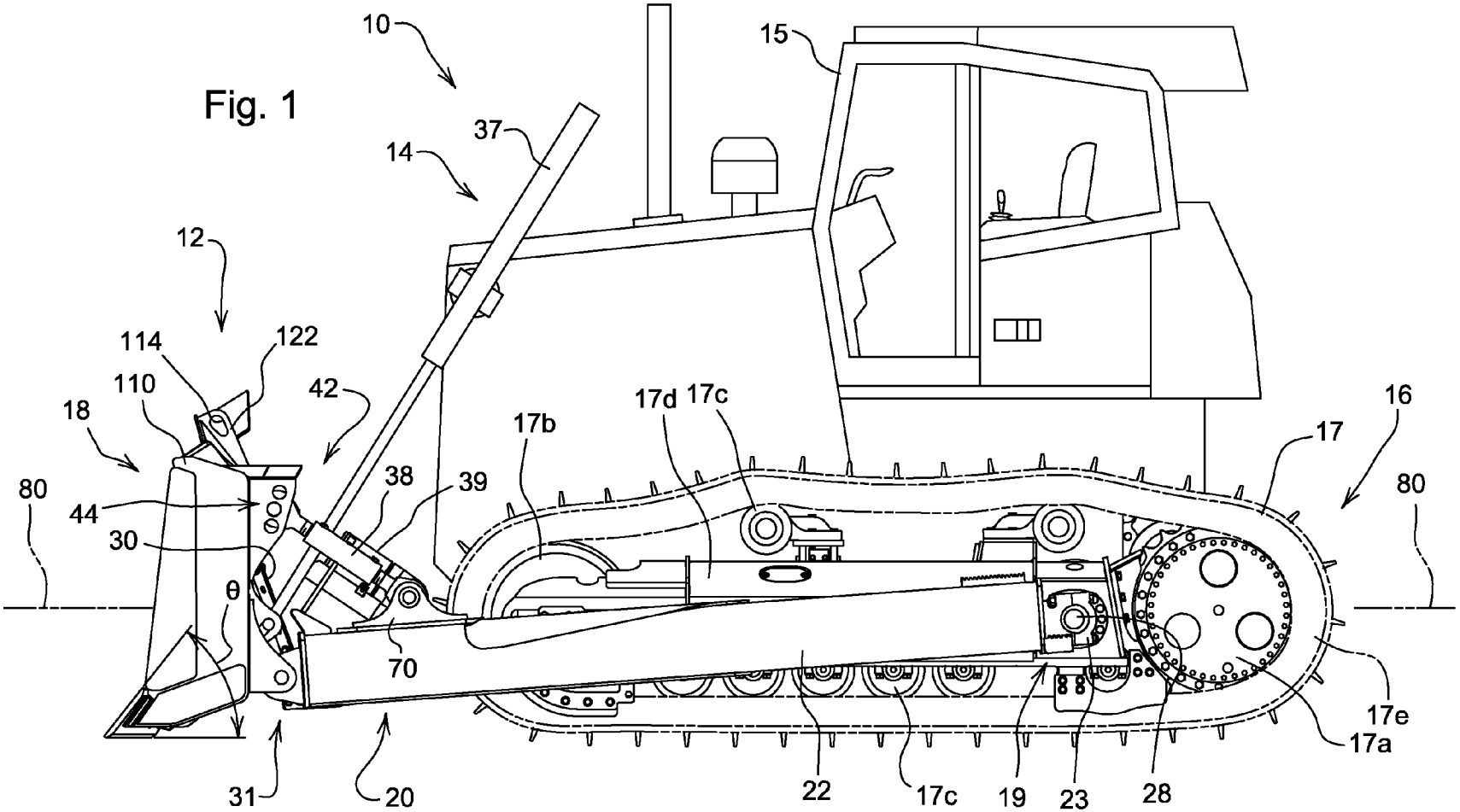
FIG. 1 is left side elevation view showing a work vehicle exemplarily in the form of a crawler dozer having a base machine (shown in simplified form) and a blade apparatus having an adjustable-pitch blade and a blade driver interconnecting the blade and the base machine.

Referring to FIG. 1, there is shown a work vehicle 10 exemplarily configured as a crawler dozer (e.g., John Deere 850J crawler dozer). A blade apparatus 12 is included in and provided for use with the vehicle 10. In the case of a crawler dozer, the base machine 14 of the dozer includes an operator station 15 and a tracked undercarriage 16. From the operator station 15, a human operator can control the base machine 14 and the blade apparatus 12 attached thereto.

The undercarriage 16 has left and right track assemblies positioned on laterally opposite sides of the base machine 14 for propulsion of the vehicle 10, the left track assembly shown in simplified form at 17. Each track assembly 17 has a rear drive sprocket 17*a* rotatably coupled to a main frame of the base machine 14 (the teeth of the sprocket 17*a* may be included in circumferential segments (e.g., five such segments) aligned circumferentially about the sprocket 17*a*), a front idler 17*b*, upper and lower rollers 17*c* rotatably coupled to a track frame 17*d* of the track assembly 17, and a track 17*e* shown diagrammatically and trained about the drive sprocket 17*a*, the idler 17*b*, and the rollers 17*c*. The track 17*e* has a closed-loop chain, having two rows of interconnected links, and ground-engaging shoes mounted to the chain thereabout for engagement with the ground. A track chain tension adjuster is mounted to the track frame 17*d* and is coupled to the idler 17*b*, movable a distance fore-and-aft relative to the track frame 17*d*, to press the idler 17*b* against the chain to tension the track 17*e*. The undercarriage 16 may take any suitable form such as a conventional undercarriage.

The blade apparatus 12 includes a blade 18 and a blade driver 20. The blade 18 is configured for moving large quantities of soil, sand, rubble, or other material, earthen or otherwise. The blade driver 20 interconnects the blade 18 and the base machine 14.

Figure 2:
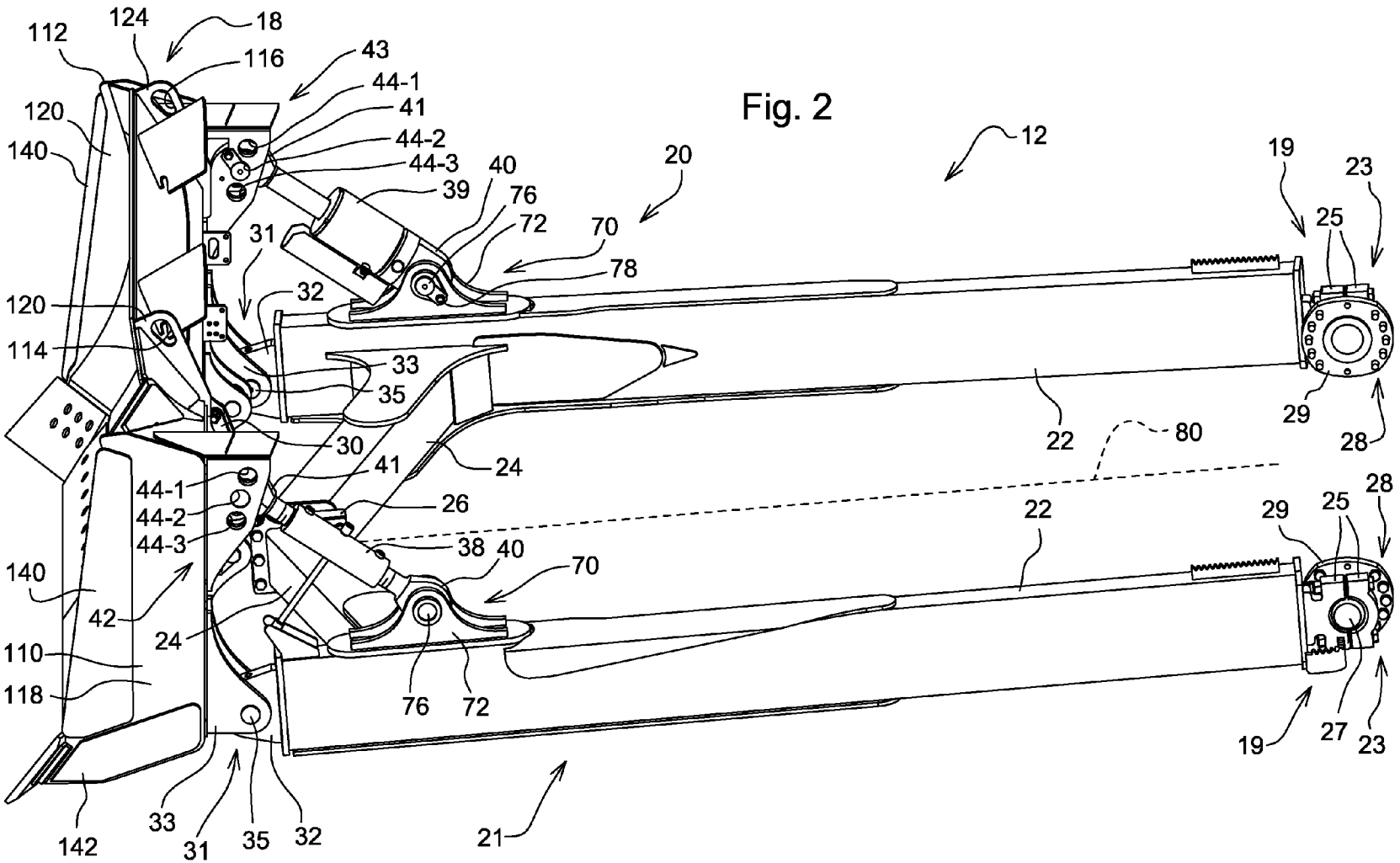
FIG. 2 is a perspective view of the blade apparatus showing a pitch link (foreground) and a tilt link (background) pivotally coupled respectively to first and second push-beams and to selected mounting points of pitch link and tilt link anchors establishing the blade at a corresponding pitch relative to the frame.

Referring to FIG. 2, the blade driver 20 includes a frame 21. The frame 21 has a pair of push-beams 22, a pair of cross-beams 24, and a center joint 26. Laterally outward ends of the cross-beams 24 are fixed respectively to the push-beams 22 through welding, and laterally inward ends of the cross-beams 24 are movably coupled to one another in, for example, a conventional manner using the center joint 26.

Exemplarily, the center joint 26 includes a pin welded to a first plate welded to the end of the first cross-beams 24, a spherical plain bearing (alternatively, a self-aligning ball bushing) receiving the pin such that the pin is movable linearly along its length within the bearing, and a center piece receiving the bearing and bolted to a second plate welded to the end of the second cross-beam 24 (welds are not shown in the drawings, but are to be understood).

The bearing may be retained in place in the center piece using two circlips, one on each side of the bearing. A link 30 pivotally coupled to a middle portion of the rear of the blade 18 and to a corner tang of the second plate interconnects the blade 18 and the cross-beams 24. The center joint 26 is thus configured to allow rotational movement between the cross-beams 24 by virtue of the bearing and movement of the cross-beams 24 toward and away from one another by virtue of the capacity of the pin to move along its length relative to the bearing. It is to be understood that the center joint 26 may be configured in any suitable manner.

The push-beams 22 are pivotally coupled to and positioned laterally outward from the undercarriage 16 in, for example, a conventional manner using a pair of pivot couplings 19. Exemplarily, each pivot coupling 31 may include a clamp 23 and a trunnion 28. The clamp 23 may have a pair of caps 25, with a first of the caps 25 fixed through welding to the rearward end of a push-beam 22, and a half-moon bushing received in the first cap 25. A ball 27 of the trunnion 28 may be received in the clamp 23 between the caps 25 with the half-moon bushing positioned between the ball 27 and the first cap 25. The caps 25 may be bolted together and shimmed as needed to receive the ball 27. A mounting plate 29 of the trunnion 28 may be bolted to the respective track frame (mounting plate bolts are shown in simplified form without threads, threads being understood). It is to be understood that the push-beams 22 may be pivotally coupled to the undercarriage 16 in any suitable manner.

The blade 18 is pivotally coupled to the frame 21 in, for example, a conventional manner using a pair of pivot couplings 31 of the blade driver 20. Exemplarily, each pivot coupling 31 may include a pivot bracket 32 fixed to a forward end of a respective push-beam 22, a clevis bracket 33 welded to an L-shaped mounting plate 34 welded to a lower portion of the rear of the blade 18 near a respective end of the blade 18, and a lubricated pin 35 extending within holes of the brackets 32, 33 and retained in place by a pin retainer 36. A spherical plain bearing may be mounted within the pivot bracket 32 and retained therein using two circlips, one on either side of the bearing, and may receive the pin 35 therethrough. As an alternative to the coupling 31, the pivot coupling may have a ball and a clamp clamping the ball, the clamp including a pair of caps, with a first of the caps fixed through welding to a forward end of a respective push-beam 22, and a half-moon bushing received in the first cap. The ball may be received in the clamp between the caps with the half-moon bushing positioned between the ball and the first cap. The caps may be bolted together (e.g., using four bolts—two on top and two bottom) and shimmed as needed. The ball may have opposite end portions received in and welded to the holes of two ears of a clevis bracket mounted to the rear of the blade 18. It is to be understood that the blade 18 may be pivotally coupled to the frame 21 in any suitable manner.

A pair of trunnion-mounted hydraulic lift cylinders 37, one of which is shown in FIG. 1, is pivotally coupled to the base machine 14 and to the blade 18 using pivot couplings in, for example, a conventional manner or any other suitable manner. Exemplarily, the cylinders 37 are mounted to either side of the base machine 14 and to the rear of the blade 18 using respective pivot couplings. The operator can raise and lower the blade 18 relative to the base machine 14 using the lift cylinders 32.

The blade apparatus 12 further includes a first or pitch link 38 and a second or tilt link 39, each having an adjustable length. Each link 38, 39 is pivotally coupled to a respective push-beam 22 and to an upper portion of the rear of the blade 18 next to an end of the blade 18. The pitch link 38 is, for example, a turnbuckle having externally threaded opposite ends and an internally threaded sleeve threaded thereto (the external threads of the turnbuckle ends shown diagrammatically and having a thread specification of, for example, M60× 3, where the "60" and the "3" represent the major diameter and pitch, respectively, both in millimeters). The external threads of the turnbuckle ends may illustratively be partially exposed outside the turnbuckle sleeve, or, in other embodiments, may be completely hidden within the sleeve to minimize exposure to debris. Alternatively, the pitch link 38 may be a fixed-length link. The tilt link 39 is, for example, a hydraulic cylinder (the extend hose and the retract hose are not shown). As such, the length of the pitch link 38 can be adjusted mechanically to change the pitch of the blade 18 relative to the frame 22, and the length of the tilt link 39 can be adjusted hydraulically, such as by the operator from the operator station 15, to change the tilt angle of the blade 18 relative to a central fore-aft axis 80 of the vehicle 10.

Each link 38, 39 is pivotally coupled to a respective push-beam 22 in, for example, a conventional manner using a link anchor 70. Exemplarily, each link anchor 70 may be mounted on the respective push-beam 22 and may provide a single mounting point for the frame end 40 of the respective link 38, 39. Each link anchor 70 may include a clevis bracket 72, welded to a mounting plate 74 welded to the top of the push-beam 22 and a lubricated pin 76. The pin 76 extends within a pair of holes of the bracket 72 and through a hole of the frame end 40 of the respective link 38, 39 and a bushing positioned on either side of that link 38, 39 and is retained in place by a pin retainer 78. It is to be understood that the links 38, 39 may be pivotally coupled to a respective push-beam 22 in any suitable manner.

The pitch and tilt links 38, 39 are pivotally coupled respectively to a first or pitch link anchor 42 and a second or tilt link anchor 43. The anchors 42, 43 are mounted to the upper portion of the rear of the blade 18 next to the ends of the blade 18.

Each anchor 42, 43 has a plurality of mounting points 44, such as three mounting points 44-1, 44-2, and 44-3. The mounting points 44 of the anchors 42, 43 are arranged in pairs of mounting points, one from the pitch link anchor 42 and one from the tilt link anchor 43, such that each pair of mounting points corresponds to a respective pitch of the blade 18 relative to the frame 21.

As such, the frame ends 40 of the pitch and tilt links 38, 39 are pivotally coupled to the frame 21 and the blade ends 41 of the pitch and tilt links 38, 39 are pivotally coupled respectively to the mounting points of a selected one of the pairs of mounting points 44-1, 44-2, or 44-3 to establish the blade 18 at the pitch corresponding to that pair of mounting points 44-1, 44-2, or 44-3. The pitch of the blade 18 can be adjusted by changing to which pair of mounting points 44-1, 44-2, or 44-3 the links 38, 39 are pivotally coupled respectively.

The top, middle, and bottom pairs of mounting points 44-1, 44-2, 44-3 are thus used to establish different pitches of the blade 18. For example, the top, middle, and bottom pairs of mounting points 44-1, 44-2, 44-3 provide a pitch of 53°, 55.3°, and 58° for the blade 18 (pitch shown as angle θ in FIG. 1), this measure of pitch illustrated between the cutting edge of the blade and a horizontal surface (e.g., the ground). As alluded to above, the pitch link 38 may have a fixed length or may have an adjustable length (as with a turnbuckle). Length adjustability of the pitch link 38 may be useful to compensate for manufacturing tolerance stack-up (e.g., variation in cylinder stroke and close lengths in the case of a cylinder for tilt cylinder 39) so as to fine-tune the system, and may be useful to provide even more fine pitch adjustment of the blade 18.

Mounting of the link anchors 42, 43 with multiple mounting points to the blade 18 rather than the push-beams 22 provides a number of benefits. It affords ergonomic pitch adjustment of the blade 18 in a location less susceptible to accumulation of packed material, without a corresponding loss of tilt angle adjustability.

Further, the anchors 42, 43 can be designed to achieve a generally desired pitch resolution between the mounting points 44-1, 44-2, 44-3, such pitch resolution limited by suitable spacing between the mounting points 44-1, 44-2, 44-3 for stress management of the anchor. For example, the anchors 42, 43 may be designed to provide a relatively fine pitch resolution (e.g., about 2.5° between adjacent pitch positions), as compared to the relatively coarse pitch resolution (e.g., about 5° between adjacent pitch positions) afforded by the afore-mentioned prior art link anchors mounted to the frame push-beams.

Such frame-mounted link anchors are limited in pitch resolution by stress considerations. More particularly, stress considerations limit their height, causing the mounting points to be arranged relative to one another more horizontally than vertically resulting in a more coarse pitch resolution, in contrast to the mounting points 44 of the link anchors 42, 43 which are arranged relative to one another more vertically than horizontally affording a more fine pitch resolution.

Since the anchors 42, 43 are mounted to the blade 18 rather than the push-beams 22, a designer has more design flexibility with respect to the pitch resolution built into the system 12. As mentioned above, the anchors 42, 43 can be designed to have a relatively fine pitch resolution. It is to be appreciated that in other examples the designer could, if desired, provide the anchors 42, 43 with a more coarse pitch resolution.

The pitch resolution is affected by the positioning of the mounting points 44 relative to the link anchors 70 and the blade 18. For sake of description, the link anchor 70 to which the pitch link 42 is coupled may be referred to as the third link anchor 70, and the link anchor 70 to which the tilt link 43 is coupled may be referred to as the fourth link anchor 70. As such, the mounting points 44 of the link anchor 42 are non-equidistant from the third link anchor 70, and the mounting points 44 of the link anchor 43 are non-equidistant from the fourth link anchor 70. The top mounting points 44-1 are positioned farther away from third and fourth link anchors 70, respectively, than the middle mounting points 44-2 such that the pitch angle corresponding to the top mounting points 44-1 is greater than the pitch angle corresponding to the middle mounting points 44-2, and the middle mounting points 44-2 are positioned farther away from the third and fourth link anchors 70, respectively, than the lower mounting points 44-3 such that the pitch angle corresponding to the middle; mounting points 44-2 is greater than the pitch angle corresponding to the bottom mounting points 44-3.

The mounting points 44 of each anchor 42, 43 are also non-equidistant from the blade 18. The top mounting points 44-1 are positioned farther away from the blade 18 than the middle mounting points 44-2, and the middle mounting points 44-2 are positioned farther away from the blade 18 than the bottom mounting points 44-3. The positioning of the mounting points 44 relative to the respective link anchor 70 and the blade 18 thus affects the pitch resolution between the mounting points.

Figure 3:
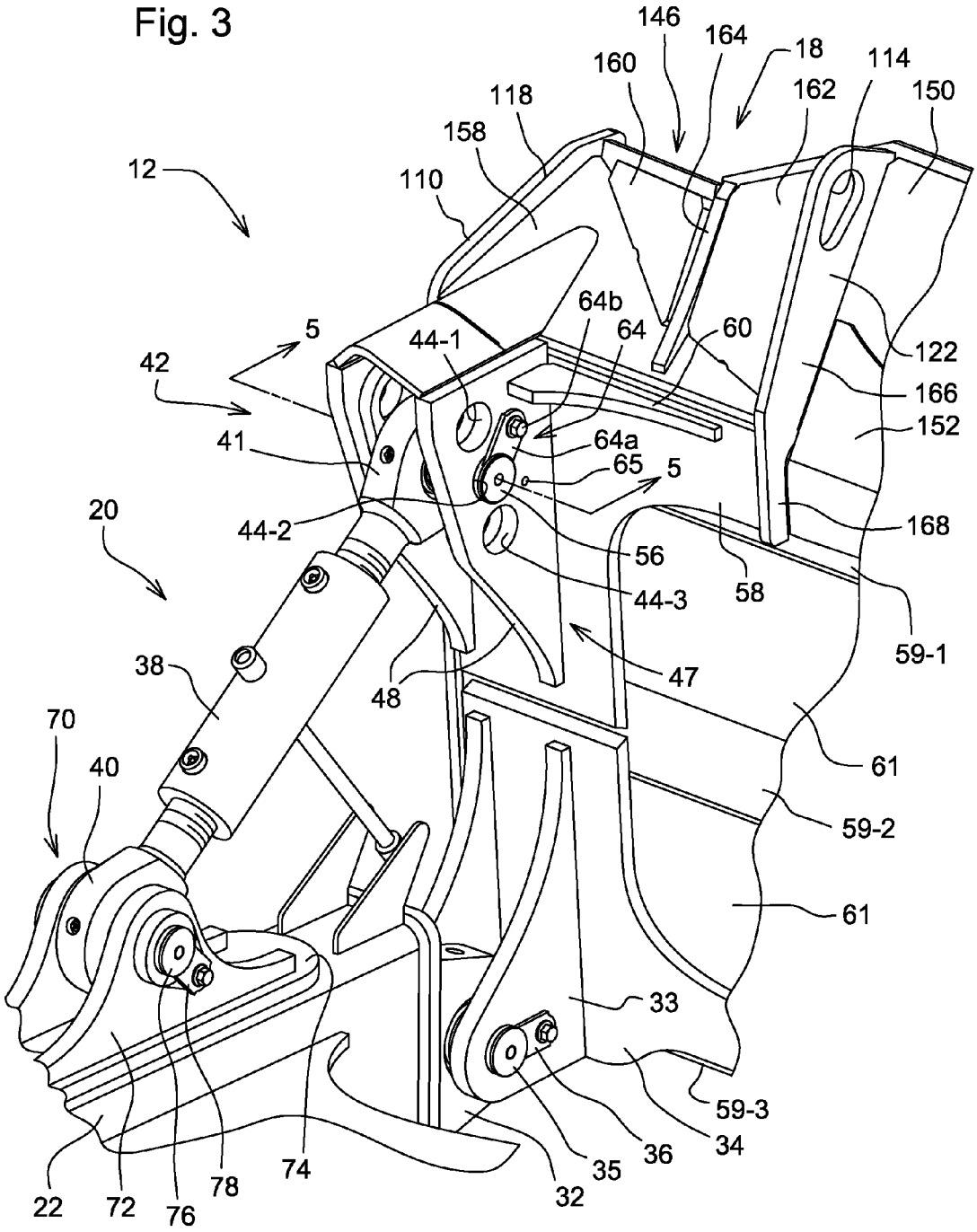
FIG. 3 is a perspective view showing a blade end of the pitch link pivotally coupled to a middle mounting point of the pitch link anchor and a frame end of the pitch link pivotally coupled to a link anchor mounted on one of the push-beams.
Figure 4:
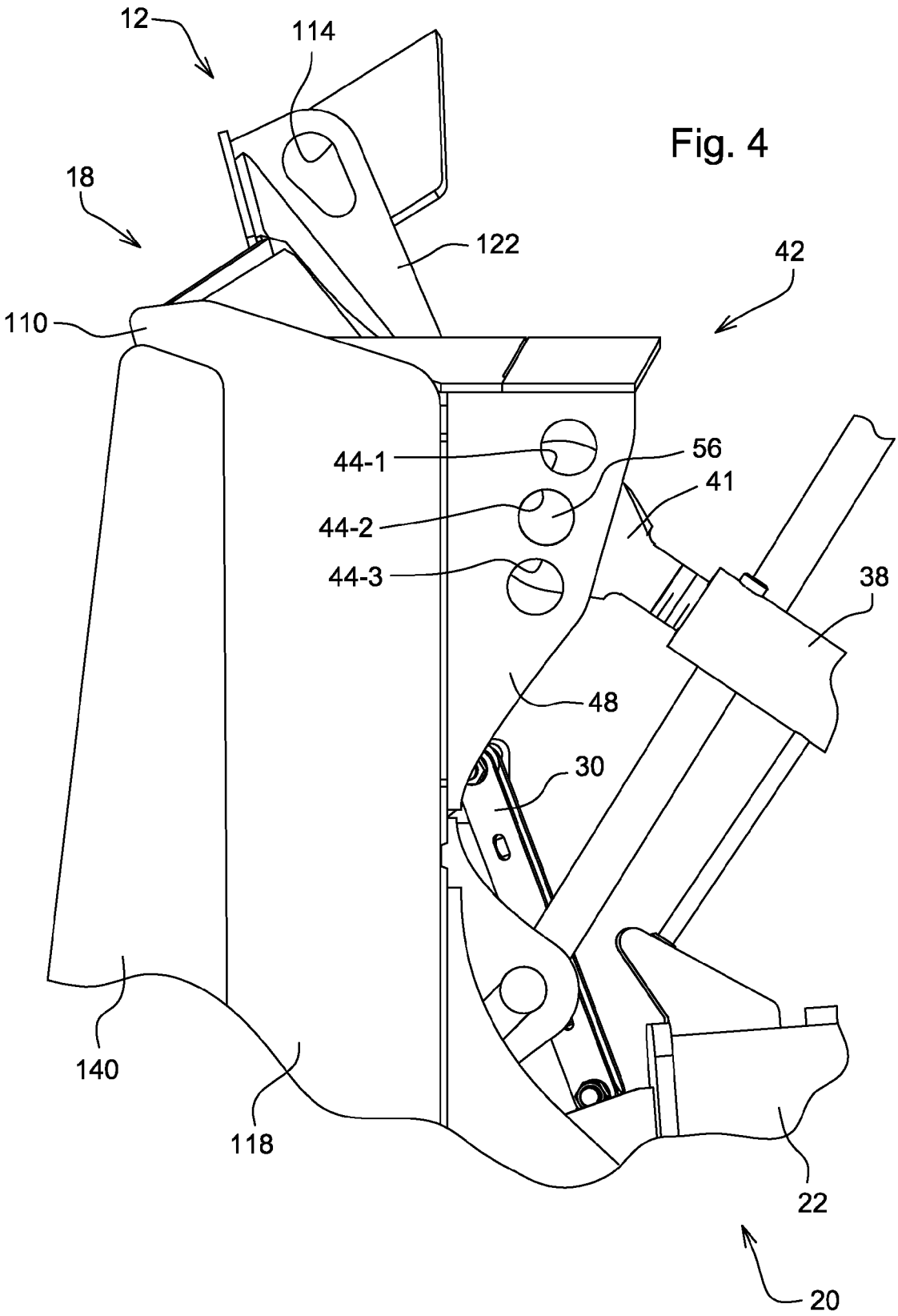
FIG. 4 is a left side elevation view showing the plurality of mounting points of the pitch link anchor.
Figure 5:
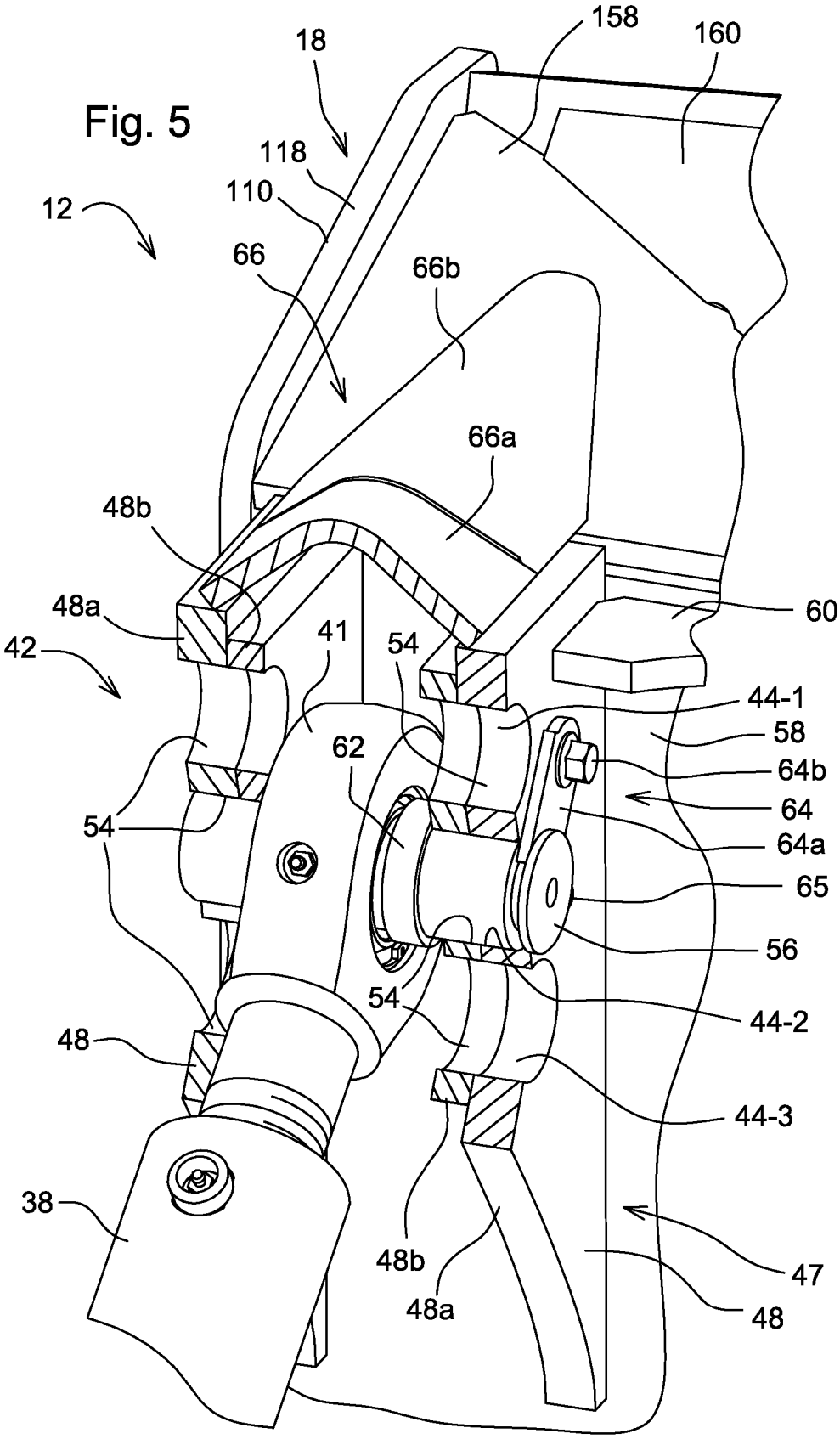
FIG. 5 is a sectional view taken along lines 55 of FIG. 3.

Referring to FIGS. 3-5, each of the anchors 42, 43 includes a clevis bracket 47 and a pin 56. The clevis bracket 47 has a first ear 48 and a second ear 48. The ears 48 are mounted to the rear of the blade 18 via an L-shaped mounting plate 58. Each mounting point 44 of each anchor 42, 43 has a pair of holes 54 (see FIG. 5). The first and second ears 48 of each clevis bracket 47 include respectively the first and second holes 54 of each mounting point 44 of that anchor 42, 43.

The holes 54 of each mounting point 44 are configured to receive the pin 56 about which the blade end 41 of the respective link 38, 39 can pivot. To establish a particular pitch for the blade 18, the pin 56 at each anchor 42, 43 is inserted into the holes 54 of the respective mounting point 44-1, 44-2, or 44-3 and fastened in place to the clevis bracket 47. To change the pitch of the blade 18, the pin at each anchor 42, 43 is unfastened and removed from the holes 54 of the current mounting point and inserted into the holes 54 of the new mounting point and re-fastened in place.

Referring to FIG. 5, each ear 48 has a main side plate **48*a* and a second plate 48*b* welded to a face of the side plate 48*a*. The plates 48*a*, 48*b* cooperate to provide the holes 54 of the ear 48. The side plates 48*a* are welded to the mounting plate 58 so as to extend rearwardly therefrom, the mounting plate 58 being welded to the rear of the blade 18, in particular to generally C-shaped top and middle channels 59-1, 59-2 and a flat upper rear plate 61 extending therebetween and welded thereto The mounting plate 58 may have a weld groove formed in a laterally outward edge of the plate 58 to receive a weld therein to facilitate welding together of the plate 58, the side plate 48*a* of the laterally outward ear 48, the channels 59-1, 59-2, and the plate 61. The rear of the blade 18 further includes a generally C-shaped bottom channel 59-3 and flat lower rear plate 61 extending between and welded to the channels 59-2 and 59-3. The mounting plate 34 is welded to the channels 59-2, 59-3 and the lower rear plate 61**.

A gusset 60 reinforces the clevis bracket 47 of each anchor 42, 43 laterally inward thereof. The gusset 60 is welded to the side plate **48*a* of the laterally inward ear 48 of the anchor 42, 43 and to the mounting plate 58**.

The blade end 41 of each link 38, 39 is received between the ears 48 of the respective anchor 42, 43. A bushing 62, one of which is shown, is positioned on either side of the blade end 41 between the blade end 41 and an ear 48 to limit play between the ears 48. The pin 56 extends in the holes 54 through the bushings 62 and the blade end 41.

Figure 6:
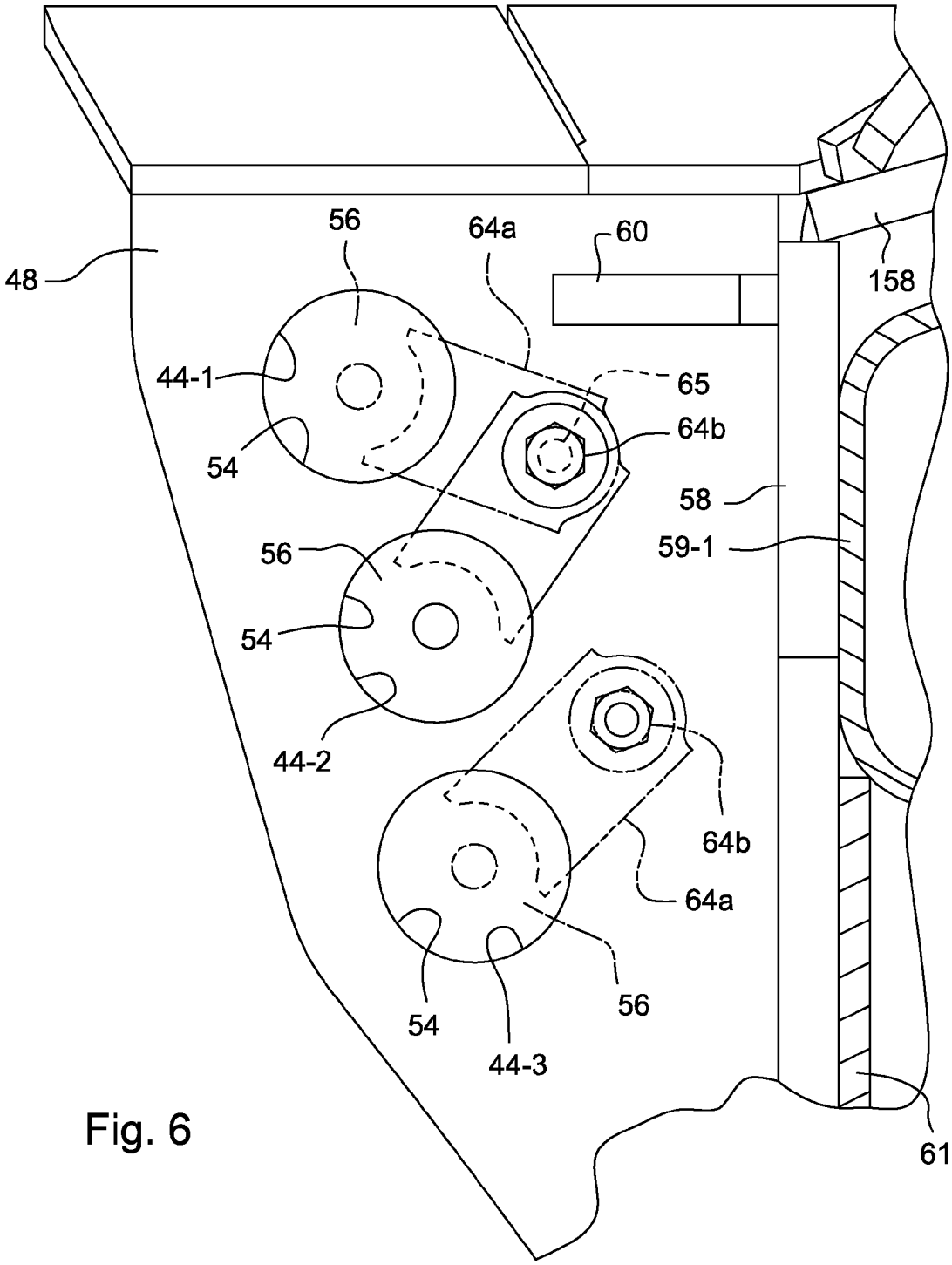
FIG. 6 is a right side elevation view of the pitch link anchor.

Referring to FIGS. 5 and 6, a pin retainer 64 retains the pin 56 in place in the holes 54 of the selected mounting point 44. The pin retainer 64 includes a retainer plate **64*a* and a fastener 64*b* securing the plate 64*a* to the side plate 48*a* of the laterally inward ear 48. The plate 64*a* is received in an annular groove formed in the pin 56. The fastener 64*b* is threaded selectively into one of two threaded retainer holes 65 (threads not shown) formed in the laterally inward ear 48. Exemplarily, each hole 65 may be a through-hole in just the side plate 48*a* of that ear 48 or a through-hole through both the side plate 48*a* and plate 48*b* of that ear 48. The fastener 64*a* is screwed into the top retainer hole 65 to secure the pin 56 in the holes 54 of the middle mounting point 44-2 (FIG. 5), and is screwed into the bottom retainer hole 65 to secure the pin 56 in the holes 54 of either the top or bottom mounting points 44-1, 44-3 (FIG. 6**).

Referring back to FIG. 5, each anchor 42, 43 further includes a cap 66 fixed to the tops of the ears 48 so as to interconnect the tops of those ears 48. Exemplarily, the cap 66 includes a bent, generally rectangular first cap plate **66*a* and a bent, generally triangular second cap plate 66*b*. The first cap plate 66*a* is welded to the tops of the side plates 48*a*. The second cap plate 66*b* is positioned between the first cap plate 66*a* and the blade 18 and is welded to the tops of the side plates 48*a*, the top of the blade 18, and the first cap plate 66*a*. A weld groove is formed in an edge of the second cap plate 66*b* for welding the first and second cap plates 66*a*, 66*b* to one another. Alternatively, the cap 66** may be a one-piece structure.

Figure 7:
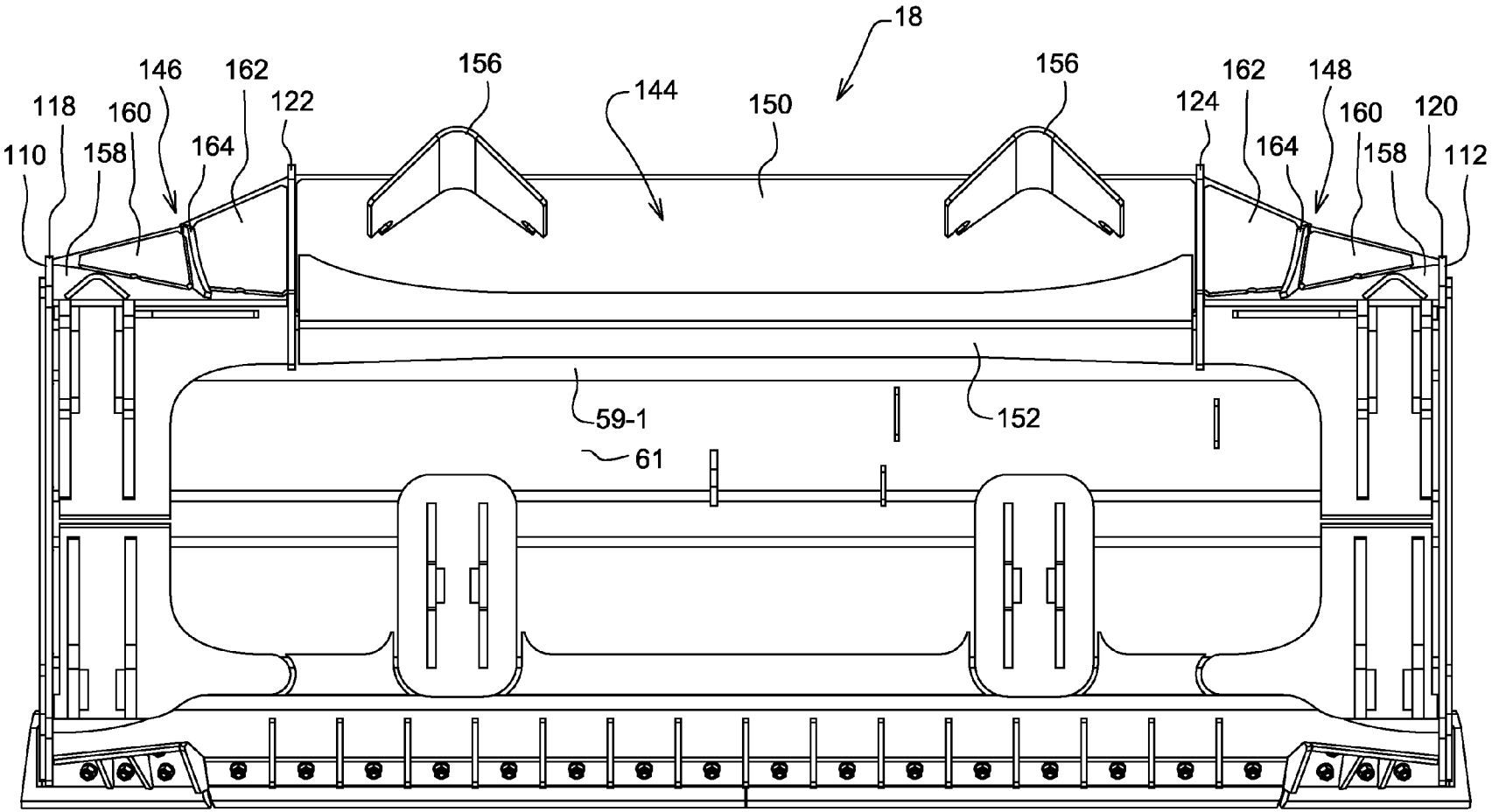
FIG. 7 is a rear elevation view of the blade.

Referring to FIGS. 2 and 7, the blade 18 has a first or left end 110, a second or right end 112, a first or left blade lift eye 114, and a second or right blade lift eye 116. The left and right ends 110, 112 are longitudinally opposite to one another. A hoist can be coupled to each of the left and right blade lift eyes 114, 116 to lift the blade 18.

The left blade lift eye 114 is positioned closer to the left end 110 than the right end 112 atop the blade 18, and the right blade lift eye 116 is positioned closer to the right end 112 than the left end 110 atop the blade 18. The left blade lift eye 114 is inboard of the left end 110, and the right blade lift eye 116 is inboard of the right end 112. Each blade lift eye 114, 116 is thus positioned in a relatively damage-free area such that the blade lift eye 114, 116 is less susceptible to damage than if it were at the respective damage-prone end 110, 112 of the blade 18. Further, the left and right ends 110, 112 of the blade 18 are lower than the left and right blade lift eyes 114, 116, respectively, enhancing operator visibility over the blade ends 110, 112 from the operator's station 15. In addition, although the blade 18 is not configured specifically for mounting of blade control towers near its ends (i.e., it does not include a bolting pattern for mounting of the towers), it is understood that, if so desired, a blade could be configured to have appropriate tower mounts for mounting a blade control tower near each end 110, 112, outboard of the lift eyes 114, 116, such that an inverted Y-shaped hoist may be coupled to the lift eyes 114, 116 without requiring prior removal of the towers from such blade.

The left blade lift eye 114 is included in a first or left lift eye plate 122 of the blade 18, and the right blade lift eye 116 is included in a second or right lift eye plate 124. The left blade lift eye plate 122 is spaced apart from and inboard of a left end-cap plate 118 positioned at the left end 110. The left lift eye plate 122 is inboard of the pitch link anchor 42, the left gusset 60 reinforcing the pitch link anchor 42, and the mounting, plate 58 mounted to the rear of the blade 18 and to which the pitch link anchor 42 and the left gusset 60 are mounted. The right lift eye plate 124 is spaced apart from and inboard of a right end-cap plate 120 positioned at the night end 112. The right lift eye plate 124 is inboard of the tilt link anchor 43, the right gusset 60 reinforcing the tilt link anchor 43, and the mounting plate 58 mounted to the rear of the blade 18 and to which the tilt link anchor 43 and the right gusset 60 are mounted.

Figure 8:
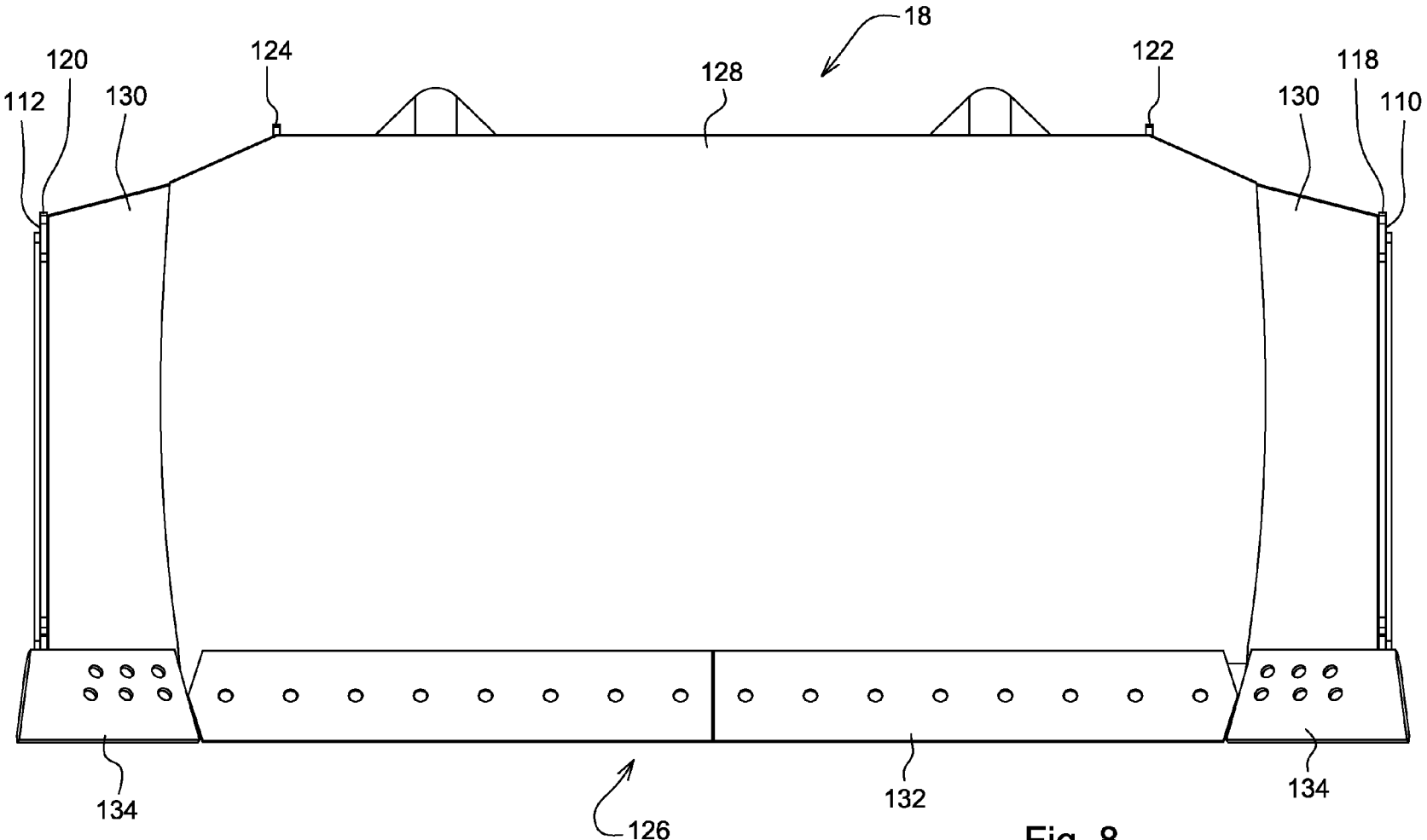
FIG. 8 is a front elevation view of the blade.

Referring to FIG. 8, the blade 18 includes a working, front wall 126 configured to perform the work of the blade 18. The front wall 126 includes a main work plate 128, two side work plates 130 flanking the main work plate 128 and welded thereto, a central cutting edge 132 bolted to a bottom portion of the main work plate 128, and two side cutting edges 134 bolted to respective bottom portions of the side plates 130.

Figure 9:
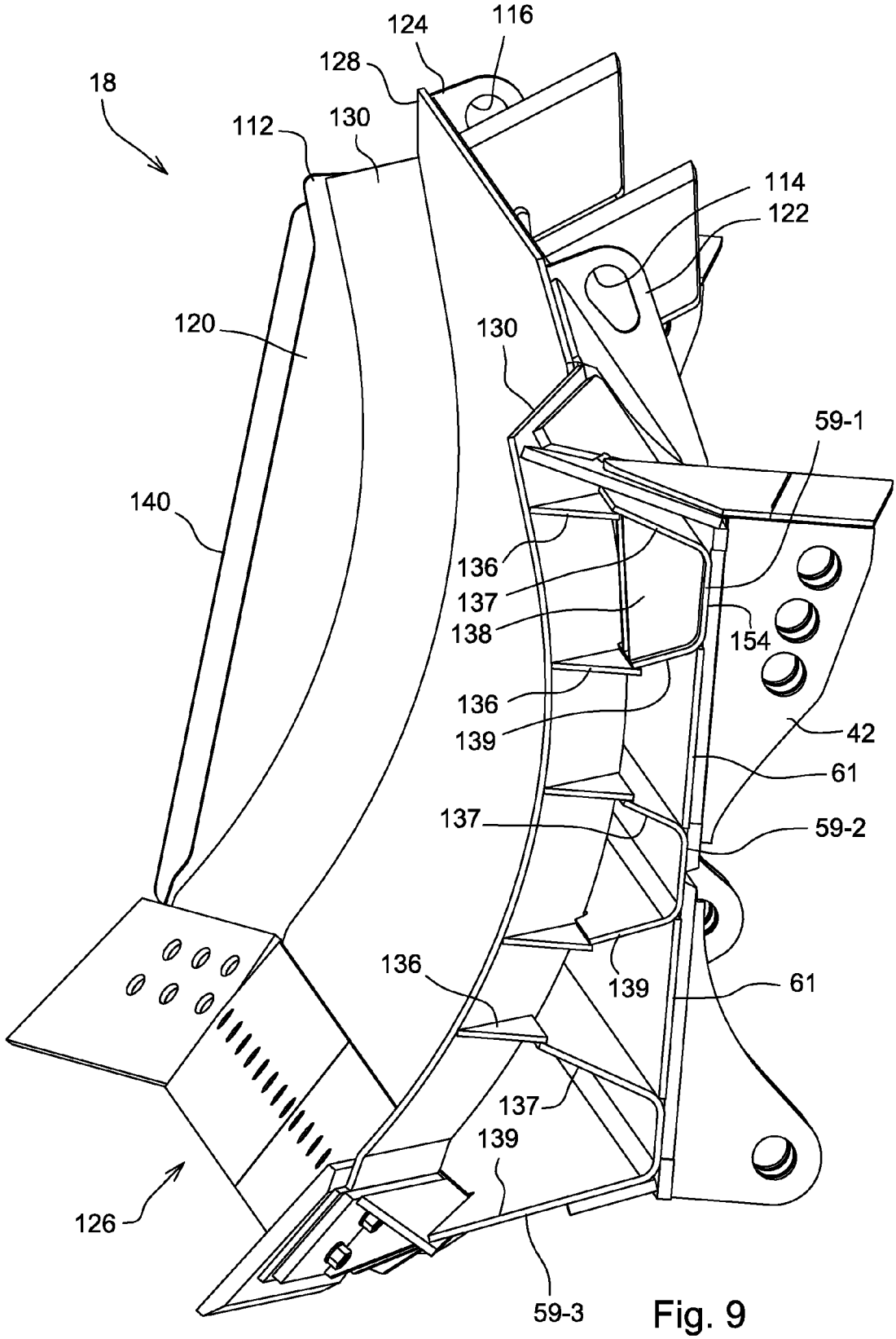
FIG. 9 is a perspective view of the blade, with portions broken away.

Referring to FIG. 9, the channels 59-1, 59-2, 59-3 are welded to the rear of the main work plate 128. To interconnect the channels 59-1, 59-2, 59-3 and the side plates 130 so as to reinforce the side plates 130, at each end region of the channels 59-1, 59-2, 59-3, gussets 136 are welded to the top and bottom walls 137, 139 of the channels 59-1, 59-2, 59-3. A pair of gussets 138 is located within the channel 59-1 at the end regions thereof for internal reinforcement of that channel 59-1.

The end-cap plates 118, 120 are fixed respectively at the ends 110, 112 of the blade 18, as shown, for example, with respect to the left end-cap plate 118 in FIG. 2. The end-cap plates 118, 120 are welded respectively to the ends of the channels 59-1, 59-2,59-3, the ends of the plates 61, the gussets 136, and the side plates 130. The end-cap plates 118, 120 thus cover respectively the ends of the channels 59-1, 59-2, 59-3. Each end 110, 112 may further include plates 140, 142 welded to the respective end-cap plate 118, 120, strengthening the respective end 110, 112 and providing some wear resistance, as shown, for example, with respect to the left end 110 in FIG. 2.

Referring back to FIG. 7, rearward of the front wall 126, an upper region of the blade 18 includes a central reinforcement structure 144 positioned between the left and right blade lift eye plates 122, 124, a left reinforcement structure 146 positioned between the left end-cap plate 118 and the left blade lift eye plate 114, and a right reinforcement structure 148 positioned between the right end-cap plate 120 and the right blade lift eye plate 116. The central and left reinforcement structures 144, 146 are welded or otherwise coupled to opposite sides of the left blade lift eye plate 122, and the central and right reinforcement structures 144, 148 are welded or otherwise coupled to opposite sides of the right blade lift eye plate 124.

The central reinforcement structure 144 includes a central plate 150 and an angle bar 152. The central plate 150 is welded to the rear of the main work plate 128 and a top wall 137 of the top channel 59-1. The angle bar 152 is welded to the central plate 150 and a rear wall 154 of the top channel 59-1. A pair of inverted V-shaped debris guards 156 may be mounted to the central plate 150 for diverting debris that may flow over the top of the blade 18 away from the lift cylinders 37.

Figure 10:
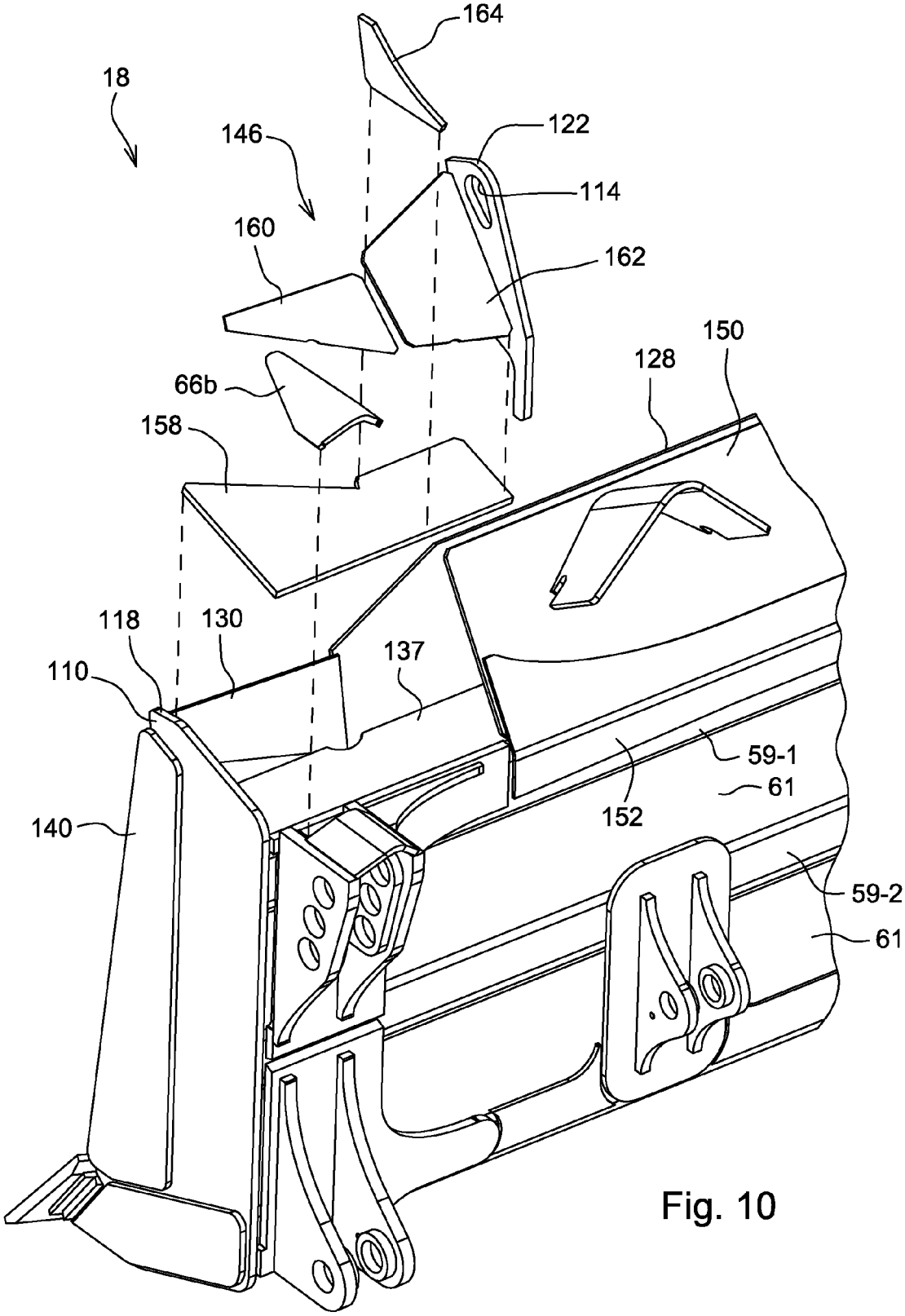
FIG. 10 is a partially exploded perspective view.

Referring to FIGS. 7 and 10, each of the left and right reinforcement structures 146, 148 includes a base plate 158, a generally triangular laterally outward plate 160, a generally trapezoidal laterally inward plate 162, and a generally triangular laterally intermediate plate 164 laterally between the laterally outward plate 160 and the laterally inward plate 162. The base plate 158 is welded to the respective end-cap plate 118, 120, the main work plate 128, the respective side work plate 130, and a top edge of the respective mounting plate 58. The intermediate plate 164 is mounted on edge to the base plate 158 so as to be upright and is welded to the base plate 158, a rear of the main work plate 128, and a laterally inward edge of the respective side work plate 130. The outward plate 160 leans against and is welded to a rear of the respective side work plate 130 and the intermediate plate 164. The inward plate 162 leans against and is welded to a rear of the main work plate 128 and is positioned between and welded to the intermediate plate 164 and the respective blade lift eye plate 122, 124. The illustrated notches formed in the bottom edges of the plates 160, 162 and in the top wall 137 of the top channel 59-1 are provided for manufacturing purposes, to help identify which direction the component is to be oriented.

Figure 11:
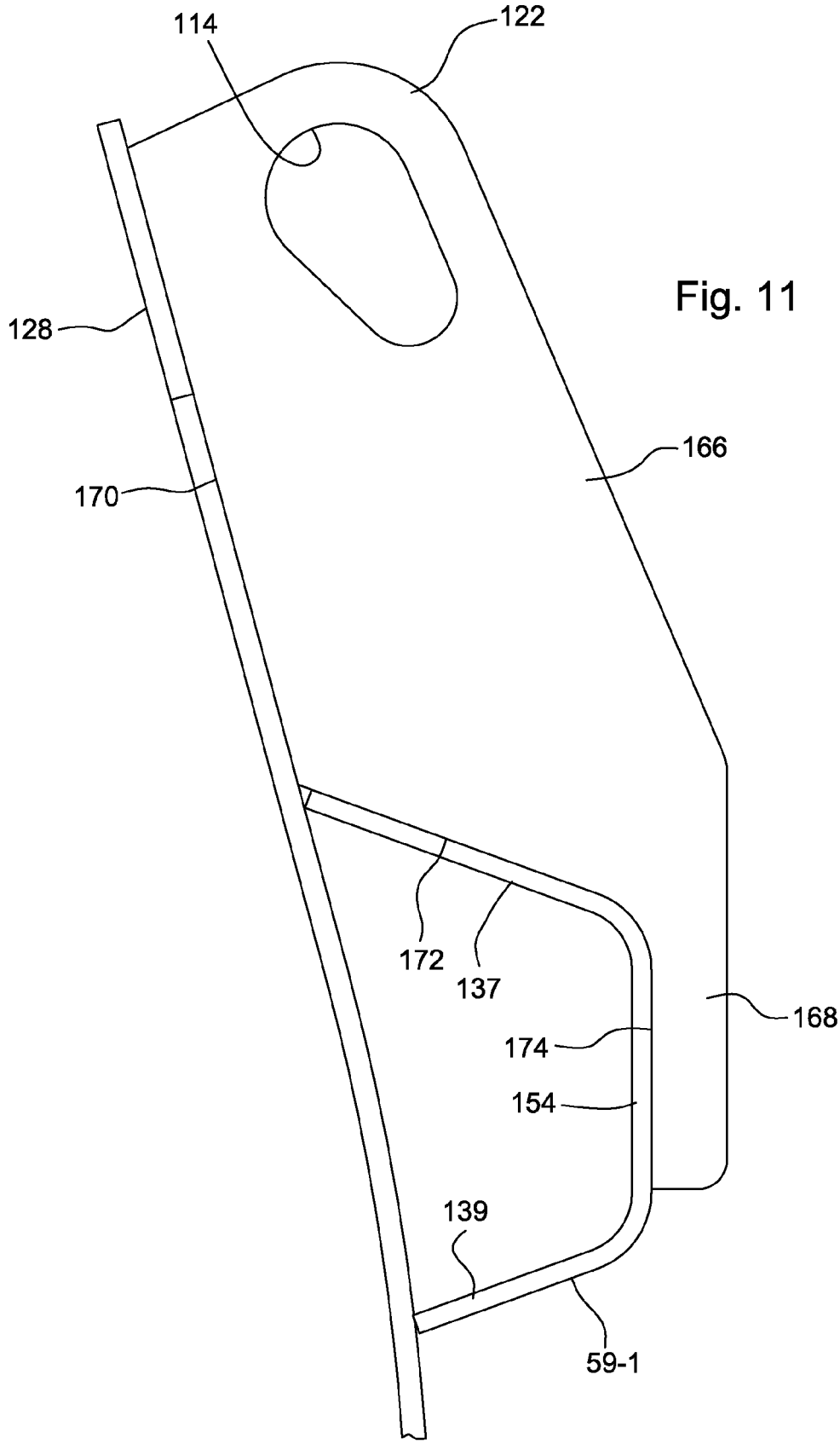
FIG. 11 is a side elevation view showing a left lift eye plate mounted to a front wall and channel of the blade.

Referring to FIG. 11, as shown, for example, with respect to the left blade lift plate 122, each of the left and right blade lift eye plates 122, 124 includes a body 166 and a tail 168 depending from the body 166 behind the rear wall 154 of the top channel 59-1, the body 166 and the tail 168 cooperating such that the respective plate 122, 124 is a one-piece construction. The body 166 of the left blade lift eye plate 122 includes the left blade lift eye 114, and the body 166 of the right blade lift eye plate 124 includes the right blade lift eye 116.

Each of the left and right blade lift eye plates 122, 124 is mounted on edge to the top channel 59-1 and the front wall 126. A front peripheral edge 170 of the body 166 is welded or otherwise mounted to the rear of the main work plate 128. A bottom peripheral edge 172 of the body 166 is welded or otherwise mounted to a top wall 137 of the top channel 59-1. A front peripheral edge 174 of the tail 168 is welded or otherwise mounted to a rear wall 154 of the top channel 59-1.

The body 166 is welded to the rear of the main work plate 128, the top wall 137 of the top channel 59-1, the respective inward plate 162, the central plate 150, and the angle bar 152 such that the body 166 is positioned laterally between the respective inward plate 162 and the central plate 150 and laterally between the respective inward plate 162 and the angle bar 152. The tail 168 is welded to the rear wall 154 of the top channel 59-1, the respective mounting plate 58, and the angle bar 152 such that the tail 168 is positioned laterally between the respective mounting plate 58 and the angle bar 152.

It is to be understood that, for purposes of the pitch and tilt link anchors 42, 43, the blade lift eyes 114, 116 may be positioned at the ends or inboard of the ends 110, 112. It is to be understood that, for purposes of the blade lift eyes 114, 116, the pitch and tilt link anchors 42, 43 may have any number of mounting points (e.g., one, two, three, or more).

The blade apparatus 12 may be made of conventional or other suitable materials. Exemplarily, the cutting edges 132, 134 may be made of hardened, wear-resistant steel. Further exemplarily, the structural components of the blade 18 and blade driver 20, as well as other components welded to the blade or blade driver 20 (e.g., ears 48, caps 66, mounting plates 58, gussets 60), may be made of high-strength, low alloy steel (e.g., plates 128, 130 having 100,000 psi yield strength and remainder having 50,000 psi yield strength).

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

What is claimed is:

1. A blade for a work vehicle, comprising first and second ends longitudinally opposite to one another relative to a longitudinal dimension of the blade, a blade lift eye that is peripherally closed and positioned closer to the first end than the second end atop the blade, the blade lift eye inboard of the first end, a blade front work wall, and a channel extending lengthwise in the longitudinal dimension of the blade rearward of the front work wall, wherein the blade lift eye is included in a lift eye plate of the blade, the lift eye plate is mounted on peripheral edge to the channel and the front work wall, and the first end is lower than the blade lift eye.

2. The blade of claim 1, further comprising an end-cap plate positioned at the first end, wherein the blade lift eye is included in a lift eye plate of the blade that is spaced apart from and inboard of the end-cap plate.

3. The blade of claim 2, wherein the channel comprises an end covered by the end-cap plate.

4. The blade of claim 3, in combination with a link anchor, a gusset inboard of and reinforcing the link anchor, and a mounting plate to which the link anchor and the gusset are mounted, wherein the lift eye plate is inboard of the mounting plate and comprises a body and a tail depending from the body, the body comprises the blade lift eye and is mounted to a top wall of the channel and to the front work wall, and the tail and the mounting plate are mounted to a rear wall of the channel.

5. The blade of claim 1, wherein the channel is welded to the front work wall and comprises a generally vertical rear wall and a top wall angled forwardly from the rear wall of the channel toward the front work wall, the lift eye plate comprises a body and a tail without a blade lift eye, the body comprises the blade lift eye in an upper portion of the body and is mounted on peripheral edge to the top wall of the channel and the front work wall, and the tail depends from a lower rear portion of the body behind the rear wall of the channel and is mounted on peripheral edge to the rear wall of the channel.

6. The blade of claim 1, in combination with a link anchor mounted to a rear of the blade and closer to the first end than the second end, wherein the blade lift eye is inboard of the link anchor.

7. The blade of claim 6, in combination with a gusset inboard of and reinforcing the link anchor, wherein the blade lift eye is inboard of the gusset.

8. The blade of claim 7, in combination with a mounting plate mounted to the rear of the blade and to which the link anchor and the gusset are mounted, wherein the blade lift eye is inboard of the mounting plate.

9. The blade of claim 1, further comprising a first reinforcement plate structure and a second reinforcement plate structure, wherein the blade lift eye is included in a lift eye plate of the blade, and the first and second reinforcement plate structures are coupled to opposite sides of the lift eye plate.

10. The blade of claim 1, wherein the blade lift eye is a first blade lift eye, the blade comprises a second blade lift eye, the second blade lift eye is positioned closer to the second end than the first end atop the blade, the second blade lift eye is inboard of the second end, the lift eye plate is a first lift eye plate, the second blade lift eye is included in a second lift eye plate of the blade, the second lift eye plate is mounted on peripheral edge to the channel and the front work wall, and the second end is lower than the second blade lift eye.

11. The blade of claim 10, further comprising a first end-cap plate positioned at the first end and a second end-cap plate positioned at the second end, wherein the first lift eye plate is spaced apart from and inboard of the first end-cap plate, and the second lift eye plate is spaced apart from and inboard of the second end-cap plate.

12. The blade of claim 11, in combination with a first link anchor, a second link anchor, a first gusset inboard of and reinforcing the first link anchor, a second gusset inboard of and reinforcing the second link anchor, a first mounting plate mounted to a rear of the blade and to which the first link anchor and the first gusset are mounted, a second mounting plate mounted to a rear of the blade and to which the second link anchor and the second gusset are mounted, wherein the channel comprises a first end covered by the first end-cap plate and a second end covered by the second end-cap plate, the first and second lift eye plates are mounted on edge to the channel and the front work wall, the first lift eye plate is inboard of the first link anchor, the first gusset, and the first mounting plate, and the second lift eye plate is inboard of the second link anchor, the second gusset, and the second mounting plate.

13. The blade of claim 10, wherein the channel is welded to the front work wall and comprises a generally vertical rear wall and a top wall angled forwardly from the rear wall of the channel toward the front work wall, each of the first and second lift eye plates comprises a body and a tail without a blade lift eye, the body of the first lift eye plate comprises the first blade lift eye in an upper portion of the body of the first lift eye plate and is mounted on peripheral edge to the top wall of the channel and the front work wall, the tail of the first lift eye plate depends from a lower rear portion of the body of the first lift eye plate behind the rear wall of the channel and is mounted on peripheral edge to the rear wall of the channel, the body of the second lift eye plate comprises the second blade lift eye in an upper portion of the body of the second lift eye plate and is mounted on peripheral edge to the top wall of the channel and the front work wall, and the tail of the second lift eye plate depends from a lower rear portion of the body of the second lift eye plate behind the rear wall of the channel and is mounted on peripheral edge to the rear wall of the channel.

14. The blade of claim 10, in combination with a first link anchor and a second link anchor, wherein the first and second link anchors are mounted to a rear of the blade, and the first and second lift eye plates are positioned between the first and second link anchors.

15. The blade of claim 14, in combination with a first gusset inboard of and reinforcing the first link anchor and a second gusset inboard of and reinforcing the second link anchor, wherein the first and second lift eye plates are positioned between the first and second gussets.

16. The blade of claim 15, in combination with a first mounting plate mounted to the rear of the blade and to which the first link anchor and the first gusset are mounted and a second mounting plate mounted to the rear of the blade and to which the second link anchor and the second gusset are mounted, wherein the first and second lift eye plates are positioned between the first and second mounting plates.

17. The blade of claim 5, wherein the channel comprises a bottom wall angled forwardly from the rear wall of the channel toward the front work wall such that the channel is generally C-shaped so as to open toward the front work wall, the body comprises a straight bottom peripheral edge mounted to the top wall of the channel and a straight front peripheral edge angled upwardly from a front portion of the bottom peripheral edge and mounted to the front work wall, and the tail comprises a straight front peripheral edge angled downwardly from a rear portion of the bottom peripheral edge and mounted to the rear wall of the channel.

18. The blade of claim 13, wherein the channel comprises a bottom wall angled forwardly from the rear wall of the channel toward the front work wall such that the channel is generally C-shaped so as to open toward the front work wall, and, with respect to each of the first and second lift eye plates, the body comprises a straight bottom peripheral edge mounted to the top wall of the channel and a straight front peripheral edge angled upwardly from a front portion of the bottom peripheral edge and mounted to the front work wall and the tail comprises a straight front peripheral edge angled downwardly from a rear portion of the bottom peripheral edge and mounted to the rear wall of the channel.

19. The blade of claim 13, comprising a central plate and an angle bar both of which are positioned between, but not under, the first and second lift eye plates so as to reinforce a side surface of the first lift eye plate and a side surface of the second lift eye plate, the central plate is welded to a rear of the front work wall and the top wall of the channel, the angle bar is welded to the central plate and the rear wall of the channel, the body of each of the first and second lift eye plates is welded to the central plate and the angle bar, and the tail of each of the first and second lift eye plates is welded to the angle bar.

20. The blade of claim 19, in combination with a first link anchor, a second link anchor, a first mounting plate mounted to the rear of the blade and to which the first link anchor is mounted, and a second mounting plate mounted to the rear of the blade and to which the second link anchor is mounted, the blade further comprising a first reinforcement plate and a second reinforcement plate, wherein the first reinforcement plate is positioned between the first lift eye plate and the first end and is welded to the front work plate and the body of the first lift eye plate, the second reinforcement plate is positioned between the second lift eye plate and the second end and is welded to the front work plate and the body of the second lift eye plate, the first lift eye plate is positioned between the central plate and the first reinforcement plate such that the central plate and the first reinforcement plate reinforce opposite side surfaces of the body of the first lift eye plate, the second lift eye plate is positioned between the central plate and the second reinforcement plate such that the central plate and the second reinforcement plate reinforce opposite side surfaces of the body of the second lift eye plate, the central plate and the second reinforcement plate reinforce opposite side surfaces of the body of the second lift eye plate, the tail of the first lift eye plate is positioned between the first mounting plate and the angle bar, and the tail of the second lift eye plate is positioned between the second mounting plate and the angle bar.

21. The blade of claim 10, comprising a central plate welded to a rear of the front work wall along a top edge thereof and to a top wall of the channel, wherein the central plate is positioned between, but not under, the first and second lift eye plates and is welded to the first and second lift eye plates, the front work wall comprises a first slanted edge slanting downwardly from the top edge toward the first end, a second slanted edge slanting downwardly from the top edge toward the second end, the top edge and the first slanted edge meet one another to form a first junction at a first end of the top edge, the top edge and the second slanted edge meet one another to form a second junction at a second end of the top edge opposite the first end of the top edge, the first lift eye plate is aligned with the first junction in a fore-aft dimension of the blade, and the second lift eye plate is aligned with the second junction in the fore-aft dimension of the blade.

* * * * *